United States Patent [19]

Gockel

[11] 4,417,624

[45] Nov. 29, 1983

[54] METHOD AND APPARATUS FOR CONTROLLING THE FLOW OF FLUIDS FROM AN OPEN WELL BORE

[75] Inventor: Charles E. Gockel, Tomball, Tex.

[73] Assignee: Conoco Inc., Ponca City, Okla.

[21] Appl. No.: 225,276

[22] Filed: Jan. 15, 1981

[51] Int. Cl.[3] ..... E21B 19/22; E21B 33/13; E21B 43/01

[52] U.S. Cl. ..... 166/362; 166/77; 166/343; 166/352

[58] Field of Search ..... 166/362, 363, 364, 343, 166/344, 77, 384, 285, 352, 335

[56] References Cited

U.S. PATENT DOCUMENTS

| | | | |
|---|---|---|---|
| 3,116,793 | 1/1964 | McStravick | 166/77 X |
| 3,313,346 | 4/1967 | Cross | 166/362 X |
| 3,373,818 | 3/1968 | Rike et al. | 166/77 |
| 3,724,567 | 4/1973 | Smitherman | 166/77 X |
| 3,765,486 | 10/1973 | Matthews et al. | 166/77 X |
| 3,841,407 | 10/1974 | Bozeman | 166/77 X |

*Primary Examiner*—Stephen J. Novosad
*Attorney, Agent, or Firm*—A. Joe Reinert

[57] ABSTRACT

A method and apparatus for controlling the flow of fluids from an open well bore, fluidly communicating the surface and a subterranean formation, the apparatus comprising (a) a slideable base;
(b) a support positioned on the base;
(c) a pipe engaging device positioned on the support above the base to urge a pipe into the open well bore; and,
(d) a pipe straightener positioned on the support means to engage the pipe and straighten it above the well bore.

A method for using the apparatus of the present invention is also disclosed.

9 Claims, 1 Drawing Figure

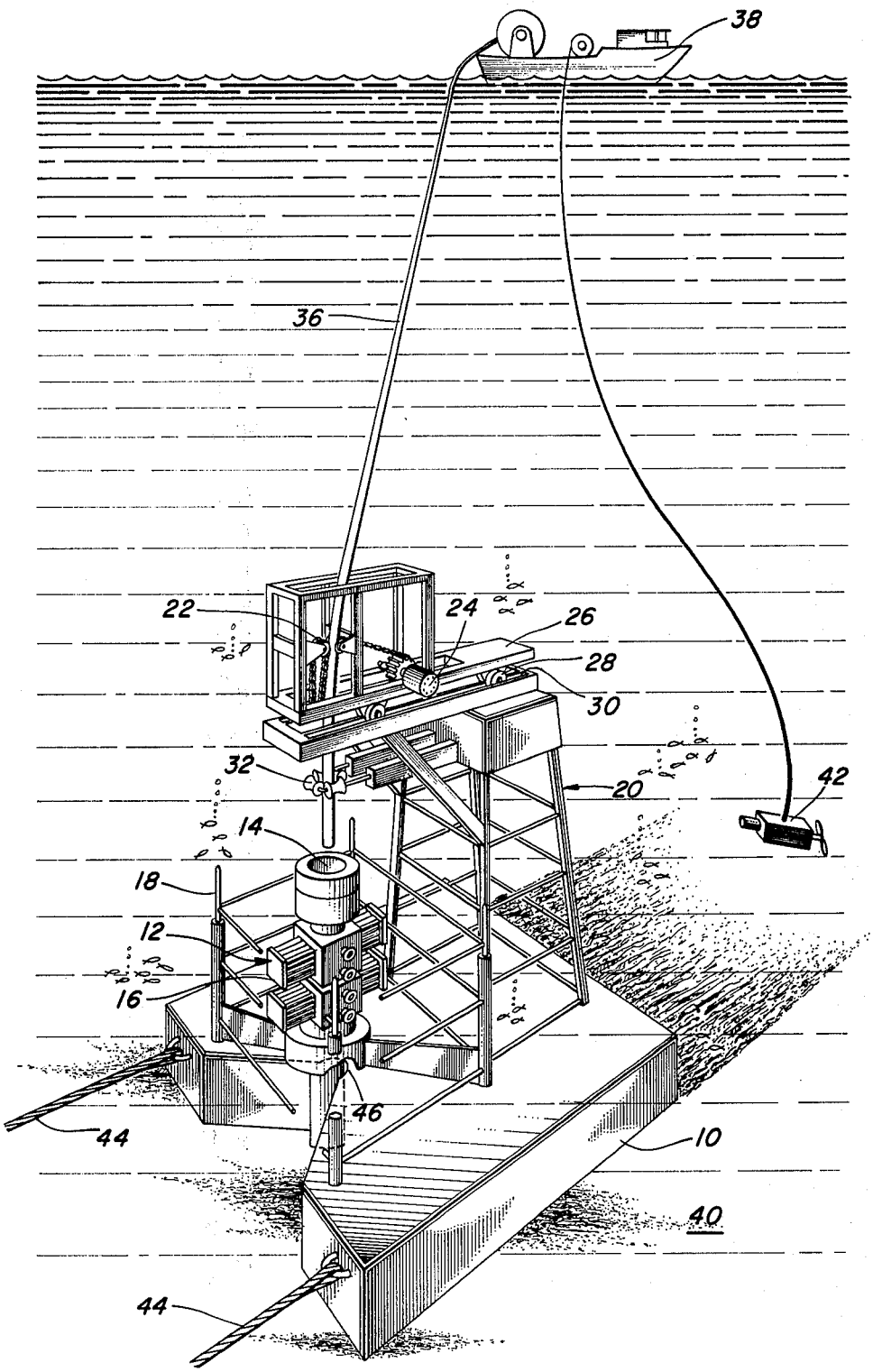
38
36
22
24
26
28
30
32
20
42
14
18
12
16
46
44
10
40
44

METHOD AND APPARATUS FOR CONTROLLING THE FLOW OF FLUIDS FROM AN OPEN WELL BORE

This invention relates to a method and apparatus for controlling the flow of fluids from an open well bore fluidly communicating the surface and a subterranean formation.

In the production of fluids such as petroleum from subterranean formations accidents occasionally occur wherein because of equipment malfunctions or the like a condition known as a blowout occurs. In such instances the flow of fluids from a subterranean formation under substantial pressure is unrestricted with the fluids flowing to the surface, i.e., a sea floor or a land surface. In such instances, it is highly desirable that a method be available for controlling or stopping the flow of such fluids because a valuable resource is being wasted and because such fluids are undesirable pollutants when released in an uncontrolled manner. Many techniques have been tested and used for controlling the flow of fluids from subterranean formations in such a fashion. In one commonly used method, additional well bores are drilled to intersect the uncontrolled well bore so that a plugging fluid such as cement, drilling mud or the like can be pumped into the formation to "kill" the well. Other techniques have involved the use of explosives and the like. In many instances, such blowouts occur during drilling operations. In such instances, it is quite common for the drill ship or drilling rig to move away from the well hastily when the blowout occurs. As a result, the well bore may be open at the well head on the ocean floor as a result of equipment malfunction or the like in off shore operations or at the well head on land. In such instances, the well bore is substantially open so that the flow of fluids is unimpeded. Accordingly, it is highly desirable that an effective method be available for stopping the flow of fluids from such open well bores.

It has now been found that control of the flow of fluid from open well bores fluidly communicating the surface and a subterranean formation is readily accomplished by the use of an apparatus comprising:

(a) a slideable base means;

(b) a support means positioned on said base means;

(c) a continuous pipe engaging means positioned on said support means above said base means, said pipe engaging means being adapted to urge a continuous pipe into said open well bore; and, (d) a pipe straightener means on said support means positioned to engage said pipe and straighten said pipe above said well bore.

In the use of such apparatus, the apparatus is positioned to pass a pipe into the well bore and thereafter a continuous pipe is fed into the open well bore to near the bottom of the well and a plugging material such as cement or drilling mud is pumped into the subterranean formation.

The FIGURE shows an embodiment of the present invention in place to feed pipe into an open subsea well bore.

In the FIGURE a slideable base 10 is shown positioned about a well head 12. The well bore 14 is open at the top and the well head 12 includes a blowout preventer 16 which in instances of blowouts is inoperative as a result of equipment malfunction or the like. In the FIGURE a guide frame 18 is shown positioned about well bore 14. Such guide frames are typically used in drilling operations to position tools and the like when the blowout preventer is located on the ocean floor. Normally such guide frames, blowout preventers and the like are positioned at a distance from about 10 to about 15 feet above the ocean floor. As a result, the outer casing of well bore 14 is clear for some substantial distance above the ocean floor 40. Base 10 is shown in a preferred embodiment as a sled-like member which is slideable along ocean floor 40 which may be cleaned of debris and the like in the vicinity of the well if required. As shown in the FIGURE, base 10 is towed into position by a pair of tow lines 44. Further, base 10 includes a slot 46 adapted to fit closely about or matingly engage well bore 14. Base 10 is shown in position about well bore 14. A support 20 is positioned on base 10 and supports a suitable pipe engaging means 22 such as a snubbing device for engaging a continuous pipe 36 which is desirably supplied from a convenient source such as a support vessel 38 and passing pipe into well bore 14. Typically continuous pipe of the type desired is wound on a spool as known to those skilled in the art and retains some curvature even after passing through snubbing device 22. Snubbing device 22 is shown as rollers which are driven by a drive means 24. Such snubbing devices comprise a chain drive mechanism as known to the art for passing coiled tubing into a wellbore. Such devices are available from Brown Oil Tool Co., Beta Division, 9330 Jackrabbit Road, Houston, Texas 77095. The pipe is engaged by snubbing device 22 and passed downwardly into well bore 14 through a straightener 32 shown as a plurality of rollers. Straightener 32 may comprise a plurality of sets of rollers and functions to straighten pipe 36 and to guide pipe 36 into well bore 14 as known to those skilled in the art. In a preferred embodiment, snubbing device 22 is mounted on a platform 26 which may be moveable relative to support 20. In the FIGURE, the movement is accomplished by the use of rollers 28 in a track 30 to permit movement between platform 26 and support 20. While not shown, hydraulic control lines or the like would normally be used to accomplish movement of platform 26, control of snubbing device 22 etc. In the FIGURE a TV camera 42 is used to observe and facilitate control of the operation of the apparatus. Divers may also be used.

In the use of the apparatus shown in the FIGURE, base 10 is desirably fabricated of steel, concrete or other suitable materials and may be either solid or hollow. If solid, or nonfloatable, base 10 is transported to the vicinity of well bore 14 and positioned so that base 10 can be dragged into position. Support 20 and the remaining portions of the apparatus can either be fabricated on base 10 at a dry dock with base 10 then being positioned as discussed above, separately from base 10 and positioned on base 10 on site or base 10 can be fabricated to be floatable in which case the entire assembly may be towed to the site and sunk at a desired location. In either event, base 10 as positioned, must be adequately stable to provide a base for the operations required in the positioning of pipe 36 in well bore 14. As indicated previously, it may be necessary in some instances to clear debris or the like from the vicinity of the well bore prior to dragging base 10 into position. Such is readily accomplished by the use of grappling hooks or the like. After base 10 and the assembly positioned on base 10 are in position over well bore 14, continuous pipe 36 is fed through snubbing device 22 and straightener 32 into well bore 14 to a depth near the bottom of well bore 14.

After pipe 36 is drawn from vessel 38 by snubbing device 22 and passed through straightener 32 into well bore 14 to an adequate depth, drilling mud, cement or other suitable plugging materials can be pumped into well bore 14 to stop the flow of fluids from the well bore. It is preferred that drilling mud or similar materials be used to plug well 14 since the well can be cleaned and subsequently used for the production of hydrocarbon fluids after the installation of suitable controls at well head 12 and the like. In the event that cement or similar material is used, the formation is normally irreparably damaged and the well is permanently plugged.

The apparatus described above may be used in a similar fashion to treat blowouts in wells on the shore although it is pointed out that the apparatus discussed is not suitable for the control of fluid flow from wells which are burning. In other words, the extreme temperature makes it very difficult to handle pipe or other materials at the top of the wellbore. Once the fire is extinguished, however, the apparatus of the present invention is suitable for stopping the uncontrolled flow of fluids from wells on land as well as wells positioned in the ocean.

Support 20 is typically of a substantial height and will vary considerably dependent upon the particular configuration of well head 12. For instance, blowout preventer stacks are typically up to about 50 feet tall, although typically such blowout preventer stacks are from about 40 to about 50 feet in height. There may be other materials attached to the well head and support 20 is designed to position snubbing device 22 and straightener 32 above the upper end of well bore 14. The snubbing device used is of a type typically used in the handling of coiled tubing as known to the art. While coiled tubing is normally from about 1 to about 1½ inches in diameter, it is preferred in the practice of the present invention that the pipe used be from about 2 to about 4 inches in diameter or larger if the inner diameter of well bore 14 permits. Any suitable pipe engaging means for engaging pipe 36 and urging it into well bore 14 is suitable. A variety of such means are known to the art and is indicated above a chain drive mechanism may be used. Normally in coiled tubing operations, smaller pipe is used, since the smaller pipe is reusable. In the present invention, the larger pipe is desirable because of the higher flow capacity through the larger pipe and since there is no requirement that the pipe be reusable. In other words, the importance of accomplishing the well shutoff is sufficient to warrant a one-time use of the larger diameter pipe.

Having thus described the invention by reference to certain of its preferred embodiments it is pointed out that many variations and modifications are possible within the scope of the present invention. Many such variations and modifications may be considered obvious and desirable by those skilled in the art upon a review of the foregoing description of preferred embodiments.

Having thus described the invention, I claim:

1. An apparatus for controlling the uncontrolled flow of fluid from an open well bore on the floor of a body of water fluidly communicating the body of water and a subterranean formation, said apparatus comprising:

(a) a slideable base means adapted to slide along the floor of the body of water;

(b) a support means positioned on said base means;

(c) a continuous pipe engaging means positioned on said support means above said base means, said pipe engaging means being adapted to urge a continuous pipe into said open well bore;

(d) a pipe straightener means on said support means positioned to engage said pipe and straighten said pipe above said well bore for urging into said open well bore;

(e) means for moving the base means into position on the floor of the body of water near the open well bore;

(f) a support vessel adapted to carry and play out the continuous pipe from the surface to the continuous pipe engaging means.

2. The apparatus of claim 1 wherein said slideable base means includes a slot configured to fit closely about said well bore.

3. The apparatus of claim 1 wherein said pipe engaging means is positioned on a platform means, said platform means being moveably positioned on said support means to facilitate the positioning of said pipe engaging means above said open well bore.

4. The apparatus of claim 3 wherein said pipe straightener is positioned between said pipe engaging means and said open well bore.

5. The apparatus of claim 1 wherein said apparatus includes means for controlling the position of said pipe engaging means with respect to said open well bore.

6. The apparatus of claim 1 wherein said apparatus includes means for controlling the feeding of said pipe into said well bore through said pipe engaging means.

7. A method for controlling the uncontrolled flow of fluid from an open well bore on the floor of a body of water fluidly communicating the body of water and a subterranean formation, said method consisting essentially of (a) positioning an apparatus comprising a slideable base means including a support means for positioning a pipe engaging means and a pipe straightener means above said open well bore;

(b) passing a continuous pipe into said open well bore through said pipe engaging means and said pipe straightener means to near the bottom of said well bore; and (c) pumping a plugging material into said well bore to control the flow of fluid from said well bore.

8. The method of claim 7 wherein said plugging material is a drilling mud.

9. The method of claim 7 wherein said plugging material is cement.

* * * * *